US005347338A

United States Patent [19]

Weibel

[11] Patent Number: 5,347,338

[45] Date of Patent: Sep. 13, 1994

[54] METHOD FOR AUTOMATED LABORATORIES OF DEVELOPING PHOTOGRAPHIC FILMS AND A MAGAZINE FOR STORING ROLLS OF FILM FOR IMPLEMENTING THE METHOD

[75] Inventor: Clemens Weibel, Lutry, Switzerland

[73] Assignee: Fotolabo S.A., Ropraz, Switzerland

[21] Appl. No.: 45,820

[22] Filed: Apr. 9, 1993

[30] Foreign Application Priority Data

Apr. 10, 1992 [CH] Switzerland ..... 1187/92-2

[51] Int. Cl.[5] ..... G03D 13/08

[52] U.S. Cl. ..... 354/340

[58] Field of Search ..... 354/354; 235/381; 355/133; 364/513; 209/3.3, 565

[56] References Cited

U.S. PATENT DOCUMENTS 3,868,018 2/1975 Theis ..... 211/40
4,186,837 2/1980 Popiel et al. ..... 209/565
4,693,373 9/1987 Lamb et al. ..... 209/3.3
4,839,505 6/1989 Bradt et al. ..... 235/381
4,928,245 5/1990 Moy et al. ..... 364/513

*Primary Examiner*—D. Rutledge
*Attorney, Agent, or Firm*—Wood, Emhardt, Naughton Moriarty & McNett

[57] ABSTRACT

The whole of the technical and commercial data relative to each film is picked up by means of an electronic processing unit and these data are memorized on a data base. The rolls of film are stored in a structured storage member with the position of each roll being identified and memorized on the data base, the said storage member serving as intermediary between the pick-up unit and the splicer, so as to dissociate the pick-up and the splicing and render these two operations not immediately interdependent in time. The magazine comprises one compartmented container of circular shape, each compartment being arranged to receive one roll. The compartments for receiving the rolls are arranged in a spiral along one face of a disc.

24 Claims, 4 Drawing Sheets

METHOD FOR AUTOMATED LABORATORIES OF DEVELOPING PHOTOGRAPHIC FILMS AND A MAGAZINE FOR STORING ROLLS OF FILM FOR IMPLEMENTING THE METHOD

The invention is concerned with a method of developing photographic films for automated laboratories in which the films of the same format are dealt with in groups thanks to an operation of splicing (automatic opening of the rolls and automatic connection of the films end-to-end). It is equally concerned with a magazine for storing rolls of film and a device for implementing the method.

BACKGROUND OF THE INVENTION

More than 95% of photographic films which are sold and used at present are of 135 format, which makes great rationalization possible and highly efficient automation of the developing.

For this purpose the large laboratories for developing photographic films are equipped with various machines which are arranged for treating a large number of films in a chain so as to reduce human intervention as far as possible.

These large laboratories generally receive the films to be dealt with enclosed individually in pouches enabling them to be sent, for example, through the post. Thus the first operation to be carried out consists in sorting the pouches as a function of the various technical and commercial criteria such, in particular, as the matt or glossy character of the paper and the format of the printing.

Once the pouches have been sorted according to these criteria, the films which answer one and the same definition are assembled end-to-end so that they form one long ribbon enabling treatment truly in series.

In order to group the films into one continuous ribbon of film, machines are employed which allow a plurality of films to be connected automatically in series. These machines (daylight film splicers) are arranged so as to enable an operator to introduce the rolls of film into them while still closed, the machine carrying out automatically and in absolute darkness the opening of the rolls, the unwinding of the films and the connection of the films end-to-end, which enables the operator to work in daylight. Previously, in fact, the operators used to stick the films together by hand and hence had to work in an infra red ambient. A machine of this type is described, for example, in U.S. Pat. No. 4,543,151.

Each splicer is coupled to a data unit equipped with a station for picking up data, which enables data which is individual to the order associated with each roll of film, to be picked up in succession for each roll just before the introduction of the roll into the machine. Thus the association of the data picked up with the physical film is effected by correspondence between the order in which the data are picked up and the order in which the films are placed end-to-end.

In an automated laboratory the orders are generally dealt with the very day they are received. In order to be able to absorb rapidly the daily bulk of the films to be dealt with, it must be possible to carry out very rapidly the splicing of the different types of film. In order to achieve this there is scarcely any other possibility than to provide a large number of splicers working in parallel simultaneously. Now, splicers being very costly machines, the cost of investment by a laboratory becomes considerably burdened.

SUMMARY OF THE INVENTION

The aim of the present invention is to propose a method which enables the number of splicers necessary for satisfactory operation of an automated photographic laboratory to be reduced.

For this purpose the invention is concerned with a method for automated laboratories of developing photographic films in which the films of the same format are treated in groups thanks to an operation of splicing (automatic opening of the rolls and automatic connection of the films end-to-end). The invention is also concerned with a magazine for storing rolls of film as well as a device for implementing the foregoing method.

Since the method in accordance with the invention enables the picking up of the data to be dissociated from the operation of splicing, the splicer recovers its true function, that is, the connection of the films. This work no longer becomes delayed by the associated operation consisting in picking up the data, which hitherto was carried out before the introduction of each roll of film into the splicer. The splicer can thus reach its full working capacity, that is, a rate of the order of 600 films dealt with per hour.

One of the immediate and substantial advantages which result is that the splicer may be coupled at the head of no matter what chain of development.

In fact the most highly perfected chains of photographic development that one is in a way to achieving today, which are called maxilab, enable one to hope for maximum rates dictated by the rate of the slowest machine, that is, the unit for exposure of printing paper to light. At present the maximum rates are of the order of 600 films per hour, that is to say, of about 18000 pictures per hour. In order that the rate of the chain may be able to approach this maximum rate it is of course necessary that none of the stages along the chain delay this overall rate to an appreciable extent.

Now the fastest rates that can be obtained with a splicer coupled to a pick-up unit are of the order of 200 films per hour. This limited rate is due to the fact that the work is composed on the one hand of picking up the data from the orders and on the other hand of opening the roll and connecting the film to the preceding film. A delay in picking up the data from an order involves a delay in the subsequent treatment of the roll concerned. Similarly a delay or a blockage in the opening of the roll or the connection of the film delays the pick-up of the data from the order associated with the next roll.

Other advantages of the method of the invention will become apparent from the description which follows, given by way of example and referring to the drawing in which:

DESCRIPTION OF THE PREFERRED EMBODIMENTS

The method of the invention is intended for dealing in groups with films of the same format, in particular of 135 format. For each of the rolls of film, in a first stage the pick-up and memorization of the technical and commercial data relative to the film contained in the roll is carried out, in particular the data from the order indicated on the pouch containing the roll of film, as well as the DX specifications of the film, as mentioned on the roll. Then the roll is introduced into one of a plurality of structured storage magazines intended to serve as intermediaries between the pick-up unit and the splicer, the choice of the magazine being determined as a function of the type of order associated with the film, each magazine being associated with one of the order criteria at the disposal of the client. At the time of this operation the number of the magazine as well as the position of the roll in the magazine are identified and memorized. The foregoing operations are repeated for all or some of the films to be developed, after which the magazines—after they have been grouped as a function of the same type of order—may be loaded into a splicer, where this splicer may be coupled to a chain of development at the head of the chain.

Figure 1:
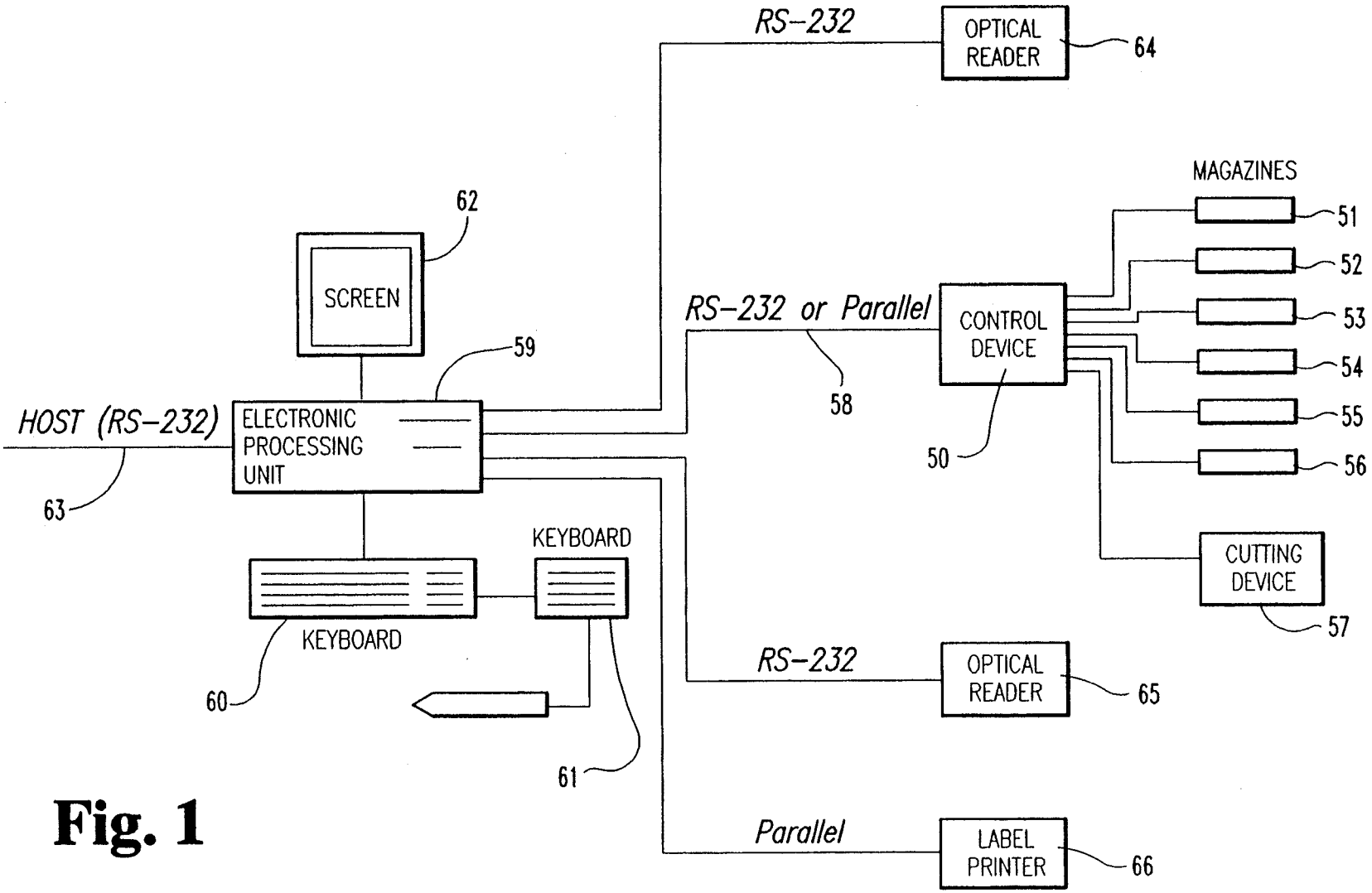
FIG. 1 is a block diagram of one example of a device for implementing the method according to the invention.
Figure 6:
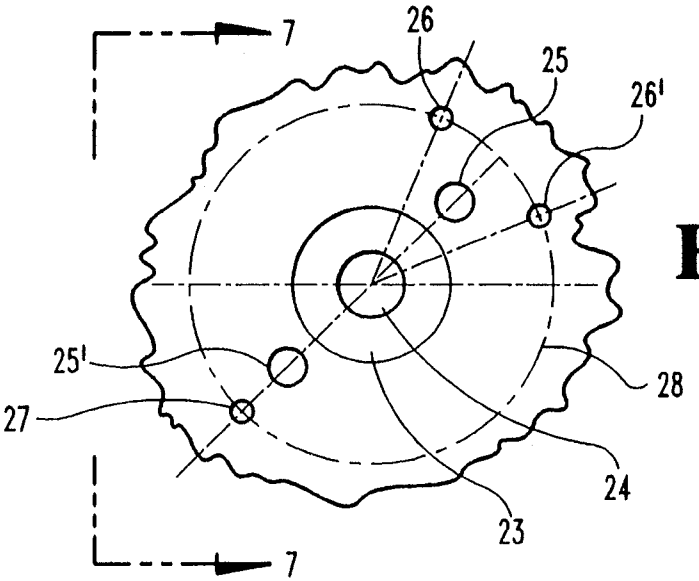
FIG. 6 is an enlargement of the detail A of the disc as in FIG. 4, illustrating a compartment intended for receiving one roll of film.
Figure 7:
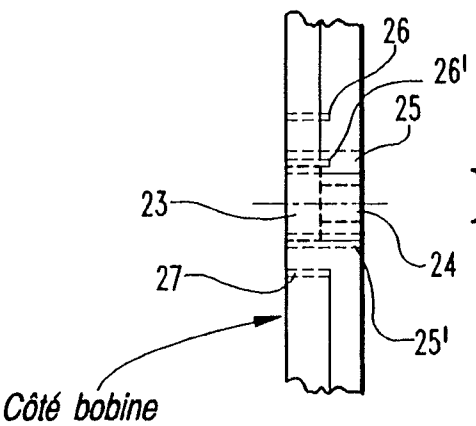
FIG. 7 is a section along the line III—III of the portion of the disc represented in FIG. 5.

The block diagram of FIG. 1 illustrates one example of a device for implementing the method of the invention. This device comprises a unit for receiving rolls of film, which enables storage of the rolls in six different magazines 51 to 56 in accordance with the type of order relative to each roll. The magazines are connected to a control device 50 which is intended in particular for controlling the opening of a flap obstructing the opening 2 from one or other of the magazines and/or the lighting of a pilot light arranged at the side of the opening from each of the magazines, as a function of the type of order relative to the roll concerned. For this purpose, the control device 50 is connected, for example, by a line of RS-232 type or of parallel type, to an electronic processing unit 59 (for example, a personal computer) equipped with a keyboard 60, 61 and a screen 62. An optical reading device 64 which enables identification of the client and reading of the order indicated on the envelope, as well as a reader 65 arranged for automatic reading of the data proper to the roll (DX) are likewise connected to the electronic unit 59. In addition a unit for printing labels, 66 intended for dealing with pouches which are unlabelled, may also be connected to the electronic unit 59. A cutting device 57 intended for opening the envelopes is on the other hand connected to the control device 50.

The arrangement described above enables one single operator to carry out the pretreatment of a large quantity of rolls of film by carrying out in succession on the one hand the pick-up of the order data relative to the roll and on the other hand the storage of the roll in one of the magazines appropriate as a function of the order data. The traditional operation of presorting is thus eliminated. The operator starts by opening the envelope containing the roll by means of the knife 57, then he identifies the type of film by presenting the roll to the optical reader 65, whereas the identification of the client and the reading of the data are effected by optical reading of the data mentioned upon the envelope, by means of the optical reader 64. As a function of the type of order indicated on the envelope, the electronic unit 59 will automatically transmit a signal to the control device 50 which then selects the magazine concerned and orders the opening of the loading flap of this magazine and/or the lighting or flashing of a lamp arranged on the said magazine at the side of its opening. The operator then has but to introduce the film into the magazine concerned, the number of which is in addition indicated upon the control device 50. During the whole cycle of treatment of one order the data picked up by the readers 64 and 65 are indicated on the screen 62, which enables the operator to check the whole time the accuracy of the data picked up. In the case where the openings in the magazines are equipped with closure flaps, it is impossible for the operator to pick the wrong magazine since only the magazine concerned is opened. If the said openings do not have closure flaps the presence of the pilot lamp considerably restricts the risks or errors. When the roll has been introduced into the magazine concerned, the disc of this magazine is moved automatically in order to position the next free compartment opposite the opening 2 in the magazine. In parallel with the foregoing operations the corresponding data are memorized thanks to the electronic unit 59.

The presence of the six magazines in the device which has just been described enables the distribution of the rolls according to six criteria that have been proposed by the client for his order. It may, for example, be a question of three different photo formats (for example 9/13, 10/15 and 13/19) combined with a choice of the printing being done on glossy or matt paper. Of course the invention is not restricted to a device having six magazines but the number of magazines may equally well be more or less than six as a function of the number of order criteria that it is desired to propose to the client.

Such a device enables the errors in pick-up to be eliminated, which can occur with the traditional organization of work.

Figure 2:
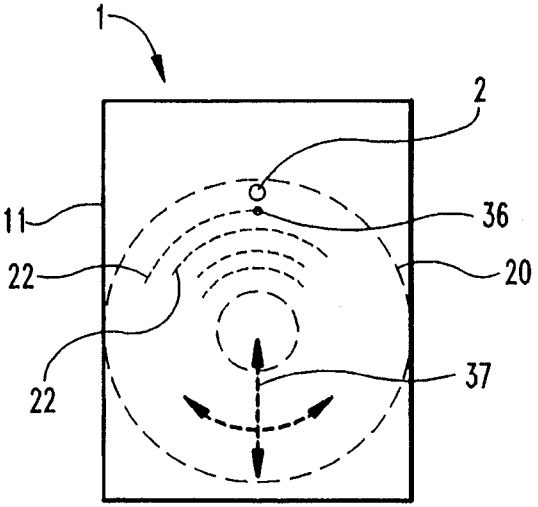
FIG. 2 is a diagrammatic plan from above on a greatly reduced scale, of an example of a magazine in accordance with the invention.
Figure 3:
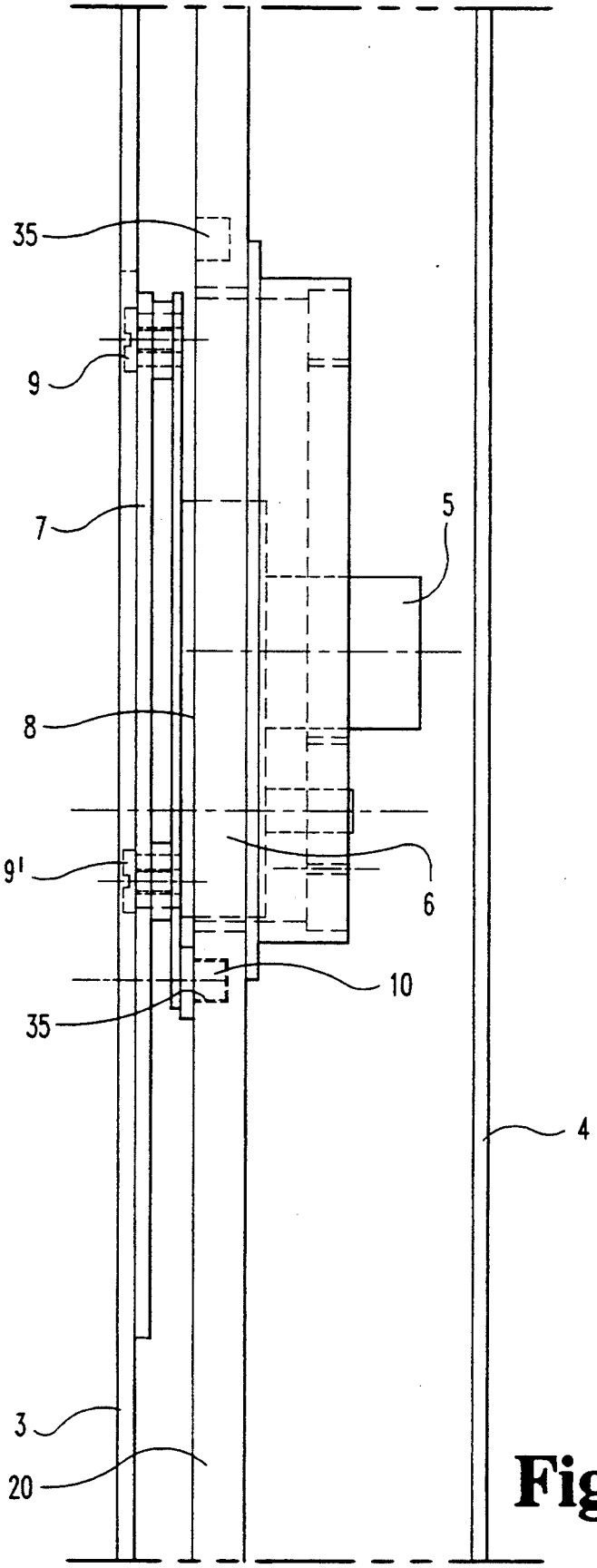
FIG. 3 is a partial vertical cross-section of the magazine as in FIG. 2, illustrating the mechanism for driving the disc.
Figure 5:
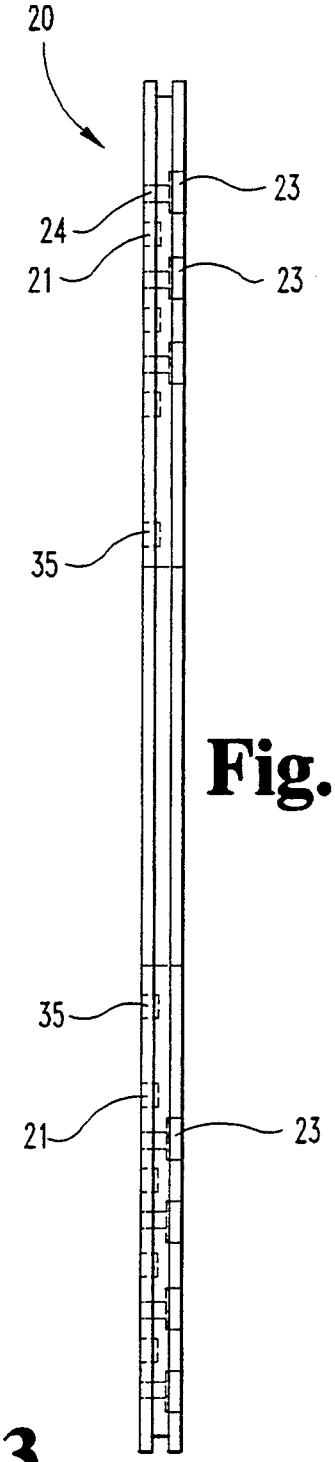
FIG. 5 is a diametral section of the disc as in FIG. 4.
Figure 4:
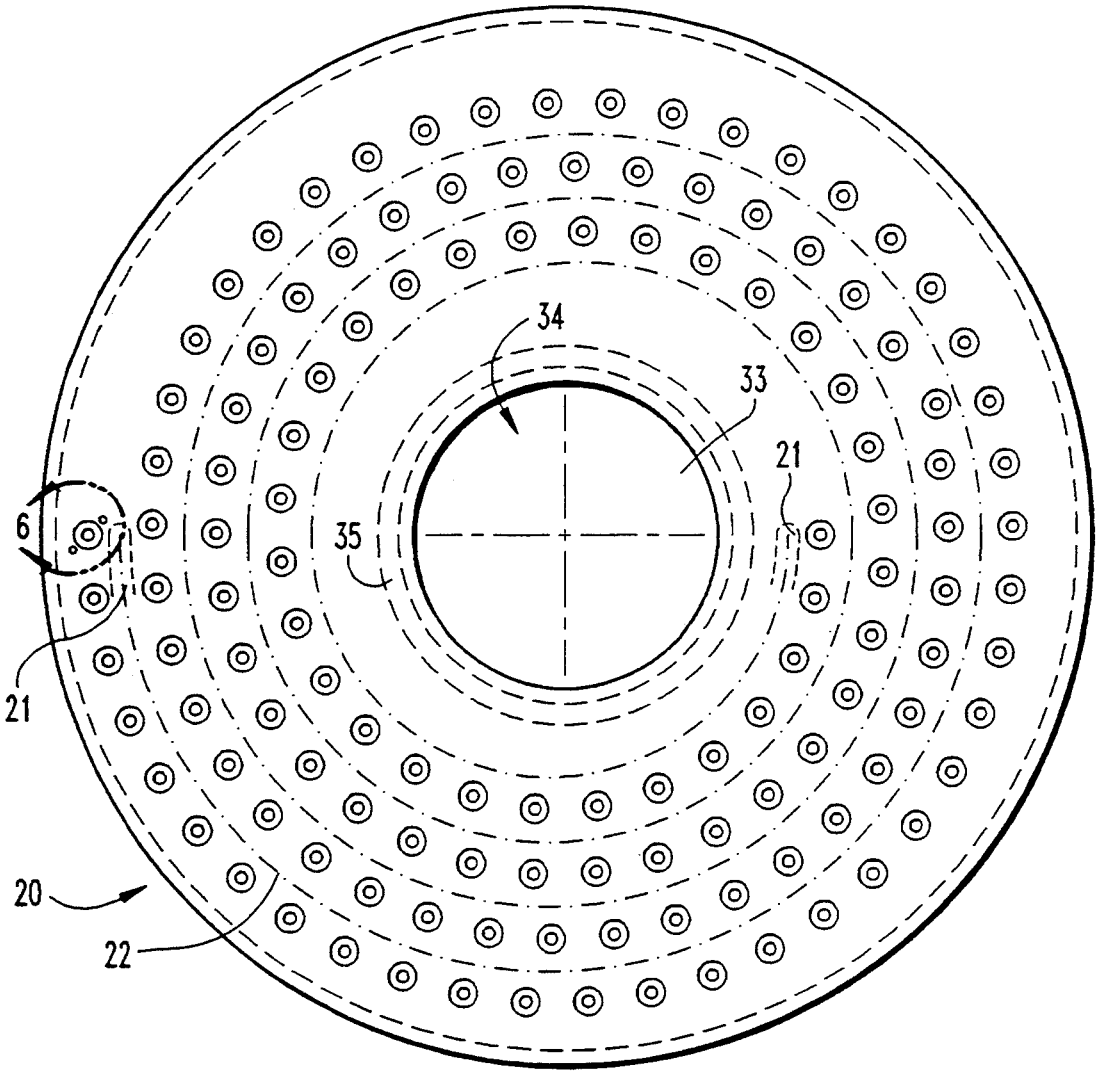
FIG. 4 is a diagrammatic plan of the rotary roll-supporting disc of the magazine as in FIG. 3.

In accordance with one embodiment represented in FIG. 2, the magazine 1 is of rectangular outer shape. It is equipped on its upper face with an opening 2 intended for loading and unloading the rolls of films. As shown partially in section in FIG. 3 the magazine comprises a baseplate 3 which, for example, is of aluminum, and an upper plate 4 which, for example, is of plexiglass, shaped so as to form with the plate 3 and side elements the casing of the magazine. A disc 20 intended to serve as a support for storage of the rolls of film is mounted inside this casing. The mounting of the disc inside the casing is realized so that the disc can on the one hand turn about itself thanks to the action of a motor 5 coupled to a reduction gear 6, the motion of rotation being on the other hand combined with a motion of translation inside the casing along a direction parallel with the edge 11 of the magazine. The combination of rotation and translation enables the compartments in the magazine to be positioned in succession opposite the opening 2 for loading/unloading the rolls of film. For this purpose, as shown in FIGS. 4 and 5 the disc includes on its rear face a groove 21 in the form of a spiral, the spiral having as in the example of FIG. 4, four-and-a-half turns. The spacing of the turns which form the groove, measured at the axis 22 of the groove, is substantially greater than the outer diameter of one roll of film. The groove 21 is intended for receiving a roller 26 for support and guidance, which is mounted permanently on the baseplate 3 and will be described later. In FIG. 4, in order to simplify the drawing, only the start and finish of the groove 21 are represented.

The central driving mechanism consisting of the motor 5 and reduction gear 6 is housed at the center of the disc, inside a circular hole 33 machined in the center of the disc. This mechanism is mounted on a support 8 in the form, for example, of a plate of hardened steel integral with two roller pinions 9, 9' mounted to slide between two plates or small longitudinal bars 7 of hardened steel, for example, attached to the baseplate 3 and forming a linear guide for the driving mechanism (from top to bottom and vice versa in FIG. 3). Only one of the small bars 7 is visible in FIG. 3, the second bar being hidden by the first. The driving of the disc 20 by the motor 5 is carried out by way of the reduction gear 6 acting by way of a pinion upon a toothed ring 34 mounted at the periphery of the central hole 33 in the disc. A roller pivot 10 mounted on the edge of the plate 8 is housed inside a circular groove 35 at the surface of the disc 20 so as to maintain the distance between the pivot of the reduction gear and the gearing inside the toothed ring when the disc is turned under the action of the motor.

The motion of rotation of the disc 20 is combined with a motion of translation in the direction 37 longitudinal to the interior of the casing 1, thanks to the presence of the guide roller 36 mentioned above (see FIG. 2). This roller is attached to the baseplate so as to lie substantially below the opening 2 for introduction-ejection of the rolls of film. Because the roller 36 is housed in the spiral groove 21 (the axis 22 of which is sketched in FIG. 2) in the disc 20, when the disc turns the spiral groove 21 is moved over the roller 36, which drives the disc in translation. The position of the roller 36 on the baseplate is chosen so that when the disc is turning the compartments 28 become positioned opposite the opening 2 for introduction-ejection.

Figure 8:
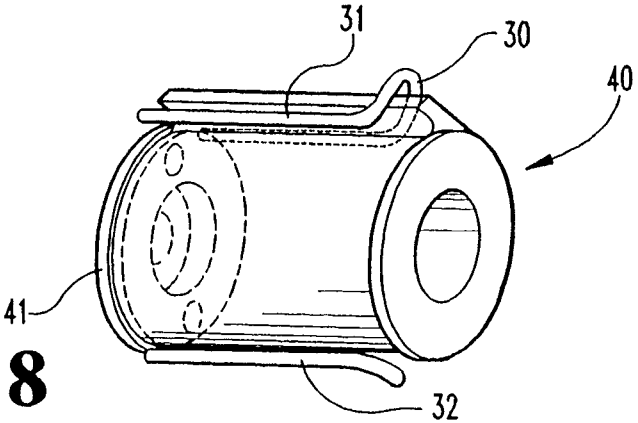
FIG. 8 is a diagrammatic perspective of a roll of film after it has been positioned in one of the compartments of the magazine.

The front face of the disc (FIG. 4) is arranged so as to form compartments, each intended for receiving one roll of film, the compartments being arranged in a spiral on the surface of the disc opposite the spiral "ribbon" formed by the groove 21. For this purpose each of the compartments is bounded by two positioning springs 31, 32 (FIG. 8), the first spring 31 in the shape of a hairpin having two arms which become embedded in holes 26, 26' in the surface of the disc 20, the second spring 32 having only one arm which becomes embedded in a hole 27 in the surface of the disc, the holes 26, 26' and 27 being arranged on a imaginary circle 28 of diameter substantially equal to the outer diameter of a roll. In addition, each compartment comprises a seating 23 cut in the surface of the disc and intended for receiving the protruding portion of circular shape situated at the end of a roll of film. The bottom of each of the seatings 23 is pierced with a hole 24 of smaller diameter than that of the seating and intended for passing through an ejection pusher which under the effect of an electromagnet acts upon the head of the roll when the latter is to be expelled from the magazine. The portion of the disc which corresponds with the bottom of each seating includes in addition two holes 25, 25' within which are seated magnetized rods intended for contributing to holding the roll in place in its seating. These magnetized rods have on the other hand the function of enabling exact the positioning of the disc opposite the opening 2 of the magazine at the location of the compartment concerned, in order to introduce into it or withdraw a roll of film, the said magnetized rods cooperating for this positioning with pick-ups arranged on the baseplate 3 opposite the opening 2 in the magazine.

The disc represented in FIG. 4 is arranged for receiving 128 films. Such an arrangement enables the realization, for example, of a magazine of outer dimensions of 53 by 44 centimeters, which makes of it an easily portable object both for its size and its weight. Here the advantage may be noted of the magazine which has just been described, with respect to a magazine with vertical stacking, for example, which in order to contain 128 films would have to have a height of 3 meters 20 (135 format films having an outer diameter of about 25 millimeters). The foregoing data are of course given only by way of example and magazines of different dimensions and/or able to receive a number of rolls of film higher or lower than 128 may equally well be realized according to the same principle.

Besides the advantages already mentioned, the method of the invention enables a device for implementing it to be realized at little cost. This is the case with the device described above by way of example. Hence one can multiply this device very easily without making the cost of a laboratory for treatment too heavy. Again, the magazines for intermediate storage of the rolls of film enable a splicer to be fed which is coupled in line at the start of a chain of photographic development, without the rate of the chain being any longer delayed by picking up the order data or by the introduction and testing of the rolls of film, since these operations have been carried out in a previous step.

I claim:

1. A method for automated laboratories of developing photographic rolls of film, in which rolls of film of the same format are and are treated in groups as the result of an operation of splicing, including automatic opening of the rolls of film and automatic connection of the films end-to-end, comprising the following steps: by means of an electronic processing unit the whole of the technical and commercial data relative to each roll of film is picked up and this data is memorized on a data base, and the rolls of film are stored in a structured storage member with a position for each roll of film being identified and memorized on the data base, the said storage member serving as intermediary between the pick-up unit and the splicing, so as to dissociate the pick-up unit and the splicing and to render these two operations not immediately interdependent in time.

2. A method as in claim 1, wherein the storage of the rolls of film is effected in a storage member structured in at least two dimensions.

3. A method as in claim 2, wherein the storage member is a plurality of magazines and for each of the rolls of film the following steps are carried out in succession:

a) by optical reading, the data of the order relative to each roll of film is picked up and memorized, as well as DX specifications of the film indicated on the roll;

b) the roll of film is introduced into a magazine as a function of the type of order relative to the roll of film, and a position for the roll of film in that magazine is marked and memorized; and the above operations are repeated so as to fill at least partially one or more magazines, each magazine being associated with one type of order, and the magazines are then loaded freely into at least one splicer.

4. A method as in claim 3, and further comprising coupling the operation of splicing to the chain of development at the head of the chain.

5. A magazine for storing rolls of film, comprising at least one compartmented container mounted within a casing, said container being designed for receiving a plurality of the rolls of film, each compartment of said container being arranged to receive one roll of film, and further comprising at least one opening in said casing the dimensions of which are substantially larger than those of one roll of film, the said opening being designed for the loading and unloading of the rolls of film, and said container and said opening being arranged so as to be able to be displaced with respect to one another so that the opening may be positioned opposite each compartment of the container in succession.

6. A magazine as in claim 5, wherein the container is circular in shape.

7. A magazine as in claim 6, wherein the container comprises a disc and the compartments intended for receiving the rolls of film are arranged in a spiral along one face of the disc.

8. A magazine as in claim 7, further including driving means for driving and displacing the disc inside the magazine.

9. A magazine as in claim 8, wherein the disc includes a second face having at least one groove intended for cooperating with means for guiding the movement of the disc.

10. A magazine as in claim 9, including means of detection of the position of the disc, which means are arranged for exact positioning of a chosen compartment opposite the opening in the magazine for loading a roll of film into or withdrawing it from the magazine.

11. A magazine as in claim 10, wherein the said means of detection comprise pick-ups integral with the casing of the magazine and arranged opposite the opening in the magazine, and means for cooperating with the pick-ups integral with the disc and positioned opposite each of the compartments.

12. A magazine as in claim 6, wherein the container comprises a disc and the compartments intended for receiving the rolls of film are arranged so as to form at least one ring along one face of the disc.

13. A magazine as in claim 7, wherein the disc includes a second face having at least one groove intended for cooperating with a member for guiding the movement of the disc.

14. A magazine as in claim 7, including means for detection of the position of the disc, which are arranged for exact positioning of a chosen compartment opposite the opening in the magazine for loading a roll of film into or withdrawing it from the magazine.

15. A magazine as in claim 14, wherein the said means for detection comprise pick-ups integral with the casing of the magazine and arranged opposite the opening in the magazine, and means for cooperating with the pick-ups integral with the disc and positioned opposite each of the compartments.

16. A device for automated laboratories of developing photographic rolls of film, in which a plurality of rolls of film of the same format are treated in groups as the result of an operation of splicing, including automatic opening of the rolls of film and automatic connection of the films end-to-end, comprising at least one electronic processing means arranged for picking up the whole of the technical and commercial data relative to each roll of film and for memorizing this data on a data base, and storage means for storing the rolls of film, and means for identifying and memorizing the position of each roll of film on the data base, the said storage means serving as an intermediary between the pick-up unit and the splicer, so as to dissociate the pick-up and the splicing and render these two operations not immediately interdependent in time.

17. A device as in claim 16, wherein the storage means is structured in at least two dimensions.

18. A device as in claim 17, wherein the storage means comprises a magazine for storing rolls of film including at least one compartmented container mounted within a casing, said container being designed for receiving a plurality of the rolls film, each compartment of said container being arranged to receive one roll of film, the magazine further comprising at least one opening in said casing the dimensions of which are substantially larger than those of one roll of film, the said opening being designed for the loading and unloading of the rolls of film, and said container and said opening being arranged so as to be able to be displaced with respect to one another so that the opening may be positioned opposite each compartment of the container in succession.

19. A device as in claim 18, wherein the container is of circular shape.

20. A device as in claim 19, wherein the container comprises a disc and the compartments intended for receiving the rolls of film are arranged in a spiral along one face of the disc.

21. A device as in claim 20, further including driving means for driving and displacing the disc inside the magazine.

22. A device as in claim 21, wherein the disc includes a second face having at least one groove intended for cooperating with a member for guiding the movement of the disc.

23. A device as in claim 22, including means for detection of the position of the disc, which are arranged for exact positioning of a chosen compartment opposite the opening in the magazine for loading a roll of film into or withdrawing it from the magazine.

24. A device as in claim 23, wherein the said means for detection comprise pick-ups integral with the casing of the magazine and arranged opposite the opening in the magazine, and means for cooperating with the pick-ups integral with the disc and positioned opposite each of the compartments and arranged for cooperating with the pick-ups.

* * * * *

UNITED STATES PATENT AND TRADEMARK OFFICE

CERTIFICATE OF CORRECTION

PATENT NO. : 5,347,338

DATED : September 13, 1994

INVENTOR(S) : Clemens Weibel

It is certified that error appears in the above-identified patent and that said Letters Patent is hereby corrected as shown below:

On the cover page, please correct the Attorney, Agent or Firm by deleting "Wood" and inserting in lieu thereof --Woodard--.

In column 6, line 40, please insert --processed through a pick-up unit-- between the words "are" and "and".

In column 6, line 67, please begin a new paragraph after the word "memorized;".

Signed and Sealed this

Second Day of July, 1996

*Attest:*

*Attesting Officer*

Bruce Lehman

BRUCE LEHMAN

*Commissioner of Patents and Trademarks*